United States Patent [19]

Lee

[11] Patent Number: 4,834,666

[45] Date of Patent: May 30, 1989

[54] ELECTRICAL PIN WITH BEND

[76] Inventor: Noel Lee, 47 W. Park Dr., Daly City, Calif. 94015

[21] Appl. No.: 259,845

[22] Filed: Oct. 19, 1988

Related U.S. Application Data

[63] Continuation of Ser. No. 32,486, Mar. 30, 1987, abandoned.

[51] Int. Cl.[4] ..... H01R 13/44

[52] U.S. Cl. ..... 439/266; 439/147

[58] Field of Search ..... 439/136, 145, 147, 206, 439/208, 655, 660, 692, 694

[56] References Cited

U.S. PATENT DOCUMENTS

| | | | |
|---|---|---|---|
| 1,817,004 | 8/1931 | Hubbell | 439/694 X |
| 2,511,806 | 6/1950 | Macy . | |
| 2,552,061 | 5/1951 | Popp | 439/136 |
| 2,701,350 | 2/1955 | Soreng . | |
| 2,825,883 | 3/1958 | Batcheller . | |
| 2,894,242 | 7/1959 | Bickford et al. | 439/694 |
| 2,974,302 | 3/1961 | Ellis . | |
| 3,139,318 | 6/1964 | Binder et al. . | |
| 3,161,451 | 12/1964 | Neidecker . | |
| 3,221,294 | 11/1965 | Roberts . | |
| 3,546,663 | 12/1970 | Holmberg . | |
| 3,825,882 | 7/1974 | Tucker | 439/694 X |
| 3,918,789 | 11/1975 | Davis . | |
| 4,073,565 | 2/1978 | Raymond . | |
| 4,304,454 | 12/1981 | Yokota . | |
| 4,738,640 | 4/1988 | Lee . | |

FOREIGN PATENT DOCUMENTS

| | | |
|---|---|---|
| 667320 | 7/1963 | Canada . |
| 1325863 | 3/1963 | France . |

*Primary Examiner*—Eugene F. Desmond

*Attorney, Agent, or Firm*—Warren B. Kice

[57] ABSTRACT

A connector for connecting an electrical conductor to an electrical terminal in which two integrally formed shank portion extend at an angle to each other. One shank portion is adapted to extend in a terminal and the other shank portion is adapted for connection to a conductor and extends downwardly from the first shank portion to minimize stress on the latter connection. A notch is formed in the one shank portion to secure the connector in the terminal.

6 Claims, 1 Drawing Sheet

ELECTRICAL PIN WITH BEND

CROSS-REFERENCE TO RELATED APPLICATION

This application is a continuation application of copending application Ser. No. 032,486 filed Mar. 30, 1987, now abandoned.

BACKGROUND OF THE INVENTION

This invention relates to an electrical connector, and more particularly to a pin-type connector for making an electrical connection between a conductor attached to the connector and a corresponding electrical terminal.

The terminals on many electronic components use a spring-loaded clip, or clasp, which, when pushed, exposes an opening for receiving an electrical conductor. Upon release the spring-loaded clasp engages the conductor to establish an electrical connection between the conductor and the terminal. Pin connectors are often crimped or soldered to the conductor in order to facilitate the connection between the conductor and the terminal. However, the connection is such that the pin extends substantially horizontally and the weight of the conductor thus creates a lever arm which puts stress on the crimped or soldered connection and thus compromises the integrity of the connection. Also, the outer coating of the pin is usually of gold, copper, brass, or other material having a relatively low coefficient of friction which can cause the pin to slip out of the spring-loaded terminal.

SUMMARY OF THE INVENTION

It is therefore an object of the present invention to provide a connector pin for attachment to an electrical conductor for establishing an electrical connection between the conductor and a spring-loaded terminal.

It is a further object of the present invention to provide a pin of the above type which is designed to minimize stress on the connection between the conductor and the pin.

It is still further object of the present invention to provide a pin of the above type in which slippage of the pin relative to the spring loaded terminal is eliminated.

Toward the fulfillment of these and other objects, the pin connector of the present invention includes a first shank portion adapted to extend in a spring-loaded terminal and a second shank portion extending from said first shank portion and at an angle to said first shank portion. The free end of the second shank portion is adapted for connection to a conductor.

BRIEF DESCRIPTION OF THE DRAWINGS

The above brief description as well as further objects, features and advantages of the present invention will be more fully appreciated by reference to the following detailed description of presently preferred but nonetheless illustrative embodiments in accordance with the present invention when taken in conjunction with the accompanying drawings wherein.

DESCRIPTION OF THE PREFERRED EMBODIMENT

Figure 1:
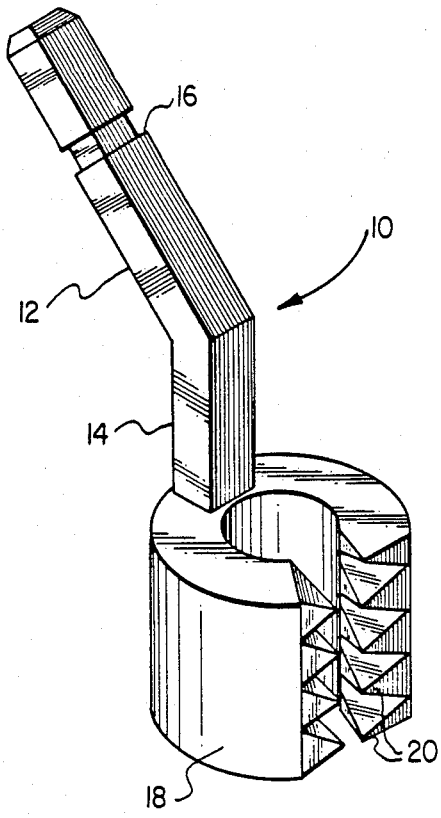
FIG. 1 is an enlarged perspective view of the connector pin of the present invention.
Figure 3:
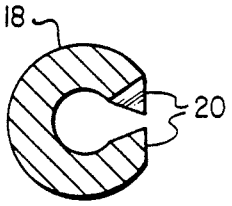
FIG. 3 is a sectional view taken along the lines 3—3 of FIG. 2.
Figure 2:
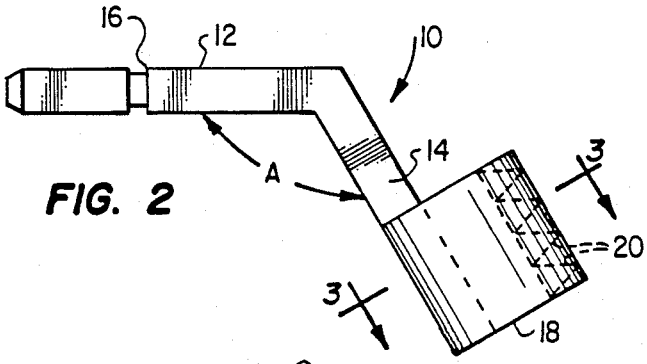
FIG. 2 is a front elevational view of the pin of FIG. 1.
Figure 4:
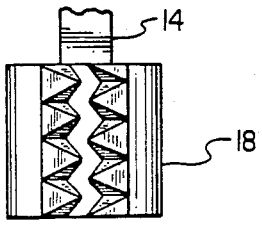
FIG. 4 is a partial side elevational view of the pin of FIG. 1.

Referring to the drawings, the reference numeral 10 refers, in general, to the pin connector of the present invention. The connector 10 is formed by two shank portions 12 and 14 extending integrally to each other and fabricated of an electrical current conducting material, such as copper, brass, or copper or brass-plated metal. As shown in FIG. 2, the shank portion 12 extends substantially horizontally in use, as will be described, and the shank portion 14 extends downwardly at an angle A to the shank portion 12. According to a preferred embodiment the angle A is approximately 60 degrees.

Each shank portion 12 and 14 has a square cross section and a notch 16 is formed around the outer perimeter of the shank portion 12 near its free end for reasons that will be described.

A crimping barrel, or sleeve, 18 extends over the free end portion of the shank portion 14 and is attached thereto in any conventional manner such as by soldering, or the like.

The sleeve 18 is formed by a strip of material, preferably of the same type as the shank portions 12 and 14, which is bent into a circular configuration with the corresponding edge portions of the strip nearly in abutment. The edge portions have serrations 20 formed thereon to engage the conductor during crimping.

Figure 5:
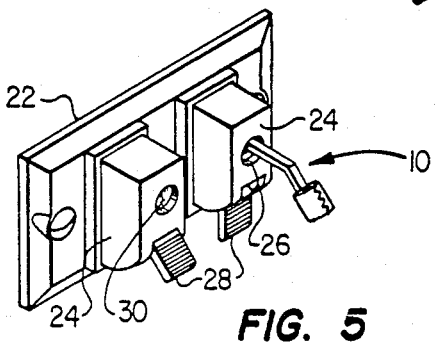
FIG. 5 is a perspective view of an electrical terminal for receiving the connector pin of the present invention.

Prior to use, the conductor (not shown) is stripped of insulation at one end portion and the latter placed in the sleeve 18. The sleeve 18 is then crimped over the stripped conductor portion by a pair of pliers, or the like, to secure the conductor in the sleeve 18. The connector 10 of the present invention is especially adapted for use with a terminal of the type having an opening for receiving a conductor. An example of this type of terminal is shown in FIG. 5 and includes a base member 22 fastenable to an electrical component. Two housings 24 are provided on the base member 22 for respectively receiving two connectors 10, only one of which is shown in FIG. 5. It is understood that the number of housings 24, and therefore connectors 10, can vary within the scope of the invention. Each housing 24 has an opening 26 formed therethrough and a spring-loaded tab 28 is pivotally mounted on each housing. The tab 28 is connected to a plate 30 which normally blocks the opening 26. The arrangement is such that when the tab 28 is pressed against the bias of its spring, it moves the plate 30 to expose the opening 26. The connector 10 of the present invention is used with this type of terminal by pushing the tab 28 to move the plate 30 and expose the opening 26, inserting the shank portion 12 into the opening, and releasing the tab so that the bias of the spring urges the plate against the connector.

The connector 10 is positioned in the opening 26 so that the plate 30 extends in the notch 16 to insure that the connector 10 will not slip out of the terminal.

The angular disposition of the shank portion 14 relative to the shank portion 12 enables the latter to extend horizontally into the spring-loaded terminal and the former to extend downwardly at an angle to the horizontal as shown in FIG. 2. This eliminates the lever arm which would otherwise be created if a straight pin was used and thus minimizes the stress on the connection between the conductor and the sleeve 18.

Thus the connector 10 of the present invention provides an electrical connection between a conductor and a terminal in a simple, quick and efficient manner.

It is understood that variations may be made in the foregoing without departing from the scope of the invention. For example, the sleeve 18 can be eliminated and the stripped conductor can be soldered directly to the end of the shank portion 14. Also, the pin connector of the present invention can be used with other types of terminals such as, for example, a terminal formed by a binding post having an opening therethrough for receiving the pin, and a nut threaded engagement with the post for securing the connection. Further, the angle A can be varied without departing from the scope of the invention.

Other modifications, changes and substitutions are intended in the foregoing disclosure and, in some instances, some features of the invention can be employed without a corresponding use of other features. Accordingly, it is appropriate that the appended claims be construed broadly and in a manner consistent with the scope of the invention therein.

What is claimed is:

1. An assembly for electrically and mechanically connecting an electrical conductor to an electronic component, said assembly comprising:

terminal means connected to said component and comprising:

a housing defining an opening, a plate, means engaging said plate for normally urging said plate to a position wherein it extends across said opening, and manually actuatable means for urging said plate from said position to expose said opening; and a connector comprising:

a base member adapted for connection to said conductor, a first shank portion extending from said base member, the axis of said first shank portion extending parallel to an extension of the axis of said base member, a second shank portion extending from said first shank portion at an angle to said first shank portion, said second shank portion being sized to extend within said opening in said housing in a substantially horizontal position with said first shank portion and said base member extending downwardly at said angle, said angle being sufficient to reduce the stress on the connection between the base member and the conductor, and a notch formed around the outer peripheral surface of said second shank portion for receiving said plate to lock said pin relative to said terminal.

2. The connector of claim 1 wherein first shank portion extends integrally with said base member.

3. The connector of claim 1 wherein said second shank portion extends integrally with said first shank portion.

4. The connector of claim 1 wherein said second shank portion has a square cross section and said notch extends around the outer perimeter of said second shank portion.

5. The connector of claim 1 wherein said base member is in the form of a crimping barrel formed on the free end of said first shank portion for receiving said conductor.

6. The connector of claim 1 wherein said angle is approximately 60 degrees.

* * * * *